US012163349B2

(12) United States Patent
Puhl

(10) Patent No.: US 12,163,349 B2
(45) Date of Patent: Dec. 10, 2024

(54) BRACING APPARATUS, SYSTEM, AND METHOD FOR INSTALLATION OF SUB-SURFACE UTILITY ANCHORS

(71) Applicant: UnWired, LLC, Centennial, CO (US)

(72) Inventor: Michael Stuart Puhl, Aurora, CO (US)

(73) Assignee: UnWired, LLC, Centennial, CO (US)

( * ) Notice: Subject to any disclaimer, the term of this patent is extended or adjusted under 35 U.S.C. 154(b) by 0 days.

(21) Appl. No.: 18/399,608

(22) Filed: Dec. 28, 2023

(65) Prior Publication Data

US 2024/0218680 A1 Jul. 4, 2024

Related U.S. Application Data

(60) Provisional application No. 63/477,620, filed on Dec. 29, 2022.

(51) Int. Cl.
*E04G 5/16* (2006.01)
*E04G 3/22* (2006.01)

(52) U.S. Cl.
CPC *E04G 5/16* (2013.01); *E04G 3/22* (2013.01)

(58) Field of Classification Search
CPC ..... E04G 3/22; E04G 5/16
USPC ..... 52/16
See application file for complete search history.

(56) References Cited

U.S. PATENT DOCUMENTS 3,988,870 A * 11/1976 Snavely ..... E02D 27/42 52/297
4,434,600 A * 3/1984 Backman ..... E04B 1/21 52/169.13
4,749,165 A * 6/1988 Moraca ..... E04G 13/021 249/48
8,056,299 B2 * 11/2011 Liskey ..... E04C 3/34 52/125.2
9,109,874 B2 * 8/2015 Simmons ..... E04G 13/021
9,937,643 B2 * 4/2018 Goss ..... E02D 27/32
2008/0072511 A1 * 3/2008 Phuly ..... E02D 27/28 52/294

(Continued)

OTHER PUBLICATIONS

International Search Report issued on Apr. 19, 2024 in PCT/US23/86319.

*Primary Examiner* — James J Buckle, Jr.
(74) *Attorney, Agent, or Firm* — Talus Law Group LLC

(57) ABSTRACT

A bracing apparatus, system, and method for the installation of sub-surface utility anchors as used for utility poles, and other infrastructure which requires a sub-surface foundational element is disclosed. The bracing apparatus may be configured to interconnect to a mounting flange or mounting surface of a utility anchor, wherein the bracing apparatus allows the lifting of a utility anchor from a horizontal orientation to a suspended vertical orientation for placing the utility anchor vertically into a hole prepared for the installation of the utility anchor. The bracing apparatus comprises a leveling means wherein the bracing apparatus resides above grade and the leveling means bears on the surrounding ground surface, is adapted to raise or lower the utility anchor in relation to the grade level, and is adapted to achieve a level configuration of the mounting flange or mounting surface of the utility anchor and thus achieve a plumb or near-plumb orientation of an above-ground infrastructure mounted to the utility anchor.

19 Claims, 17 Drawing Sheets

(56) References Cited

U.S. PATENT DOCUMENTS

2011/0061321 A1* 3/2011 Phuly ..... F03D 13/22
52/297

* cited by examiner

BRACING APPARATUS, SYSTEM, AND METHOD FOR INSTALLATION OF SUB-SURFACE UTILITY ANCHORS

This application claims the benefit of U.S. Provisional Application No. 63/477,620, filed on Dec. 29, 2022 and entitled Bracing Apparatus, System, and Method for Installation of Sub-Surface Utility Anchors.

FIELD OF THE INVENTION

The present invention is directed to the installation of sub-surface utility anchors as used for utility poles, and other infrastructure which requires a sub-surface foundational element.

BACKGROUND OF THE INVENTION

The installation of sub-surface utility anchors is common practice when installing infrastructure such as light poles, traffic lights, cellular towers, vehicle barriers, bollards, substations, and lattice towers. The use of sub-surface anchors allows for the proper support and foundation particularly for above-ground infrastructure which requires both vertical load bearing support, and moment-load support as may be experienced in high-winds or impacts such as from vehicles.

While traditional solutions of a sub-surface utility anchor involves the excavation of a hole or trench and the pouring of concrete and/or aggregate, such solutions require multiple heavy trucks and equipment. Furthermore, concrete use is problematic as it is costly, heavy to transport, and provides a limited window for use. Proper installation of the mounting flange into the concrete of the utility anchor is also problematic and time consuming. Further still, in the event that the utility anchor needs to be removed, or replaced, the excavation and removal of concrete is difficult and costly as it requires heavy machinery and many man-hours of labor. Thus, the use of poured concrete for such solutions is a prohibitively expensive solution over the lifetime of the utility anchor.

The use of prefabricated steel or precast concrete utility anchors is a common solution for the forementioned scenarios and loads. However, the process of installing such utility anchors is often burdened by the necessity for the above-ground infrastructure to be vertical and plumb. In certain instances, the utility anchor must provide a mounting flange or mounting surface with a mounting plane that is within 0.5 degrees or less of level to ensure that the above-ground infrastructure is within 0.5 degrees of plumb. Often a utility anchor must be installed, and adjusted repeatedly though a course of trial and error to accomplish a mounting plane which is perfect or within an acceptable range such as under 0.5 degrees variance. This trial-and-error often requires extended lengths of time, which results in unnecessarily high labor costs. Furthermore, any errors in installation of a utility anchor results in unnecessarily high labor costs, equipment costs, and consumables costs.

A utility anchor, as referred to herein, is a device configured for placement sub-grade to provide a structure for mounting a vertical above-ground infrastructure thereto, such as a pole or bollard, but may also include a footing for any type of structure. Often the utility anchor comprises a cylindrical form with a flange or surface at a distal end, wherein the flange or surface is configured to be level and set proximity to the ground or grade level. In certain scenarios it may be desired for the flange or surface to be sub-grade, in certain scenarios it may be desired for the flange or surface to be at grade, and in certain scenarios still it may be desired for the flange or surface to be above grade level.

Thus, there is an identified need for an apparatus, system, and process with which a utility anchor can be installed at an acceptable grade and level in a time efficient manner which mitigates trial-and-error practices and mitigates errors which lead to rework.

SUMMARY OF THE INVENTION

It is an aspect of certain embodiments of the present invention to provide a bracing apparatus, system, and method, through which a utility anchor can be installed in a time-efficient manner to mitigate labor costs, trial-and-error practices, and errors in installation which require rework.

It is an aspect of certain embodiments of the present invention to provide a bracing apparatus which is configured to be interconnected to a mounting flange or mounting surface of a utility anchor, wherein the bracing apparatus allows the lifting of a utility anchor from a horizontal orientation to a suspended vertical orientation in preparation for placing the utility anchor vertically into a hole prepared for the installation of the utility anchor. This lifting operation is often accomplished with machinery such as a crane or other mechanical means for overhead lifting.

It is an aspect of certain embodiments of the present invention to provide a bracing apparatus which allows for leveling of a utility anchor when the bracing apparatus is interconnected with the utility anchor. The bracing apparatus comprises a leveling means wherein the bracing apparatus resides above grade and the leveling means bears on the surrounding ground surface, is adapted to raise or lower the utility anchor in relation to the grade level, and is adapted to achieve a level configuration of the mounting flange or mounting surface of the utility anchor and thus achieve a plumb or near-plumb orientation of an above-ground infrastructure mounted to the utility anchor.

It is an aspect of certain embodiments of the present invention to provide a leveling indicator as related to the mounting flange or mounting surface of a utility anchor. The leveling indicator can provide a visual analog level indicator, a visual digital level indicator, or a digital level sensor which is transmitted to a controller wherein the controller is able to adjust and set the level and height of the mounting flange or mounting surface of the utility anchor automatically.

It is an aspect of certain embodiments of the present invention to allow a user to set a utility anchor at a predetermined level above grade, or to set a mounting flange or mounting surface at a certain set-height in relation to the ground level or in relation to a reference elevation.

It is an aspect of certain embodiments of the present invention to allow the interconnection of the apparatus to the mounting flange or mounting surface of a utility anchor wherein the apparatus can be configured to interconnect to a variety of styles of mounting flanges or surfaces and a variety of bolt patterns.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

In certain embodiments of the present invention, as shown in FIG. 1A-FIG. 3, a bracing apparatus 1000 comprises a base-plate 1100 having apertures 1130 therethrough, wherein the apertures 1130 are configured for interconnecting with a mounting flange or mounting surface 9100 of a utility anchor 9000. The mounting flange or mounting surface 9100 of a utility anchor typically comprises a plurality of fastening features 9130 comprising a plurality of threaded studs which extend upward, or a plurality of holes through which threaded fasteners can be inserted. The plurality of fastening features 9130 are interconnected to the mounting flange or embedded in the utility anchor so that the extend through the mounting surface. The fastening features 9130 of the mounting flange or mounting surface are typically configured on a bolt circle diameters 9135 wherein each of the fastening features 9130 is radially equidistant from a central aspect 9150 of the mounting flange or mounting surface. The apertures 1130 of the bracing apparatus are configured to align with the fastening features 9130 of a given mounting flange or mounting surface 9100, typically with a bolt circle diameter 1135 matching that of the base-plate 1100 to allow for mechanical interconnection of the base-plate to the mounting flange or mounting surface.

Figure 3:
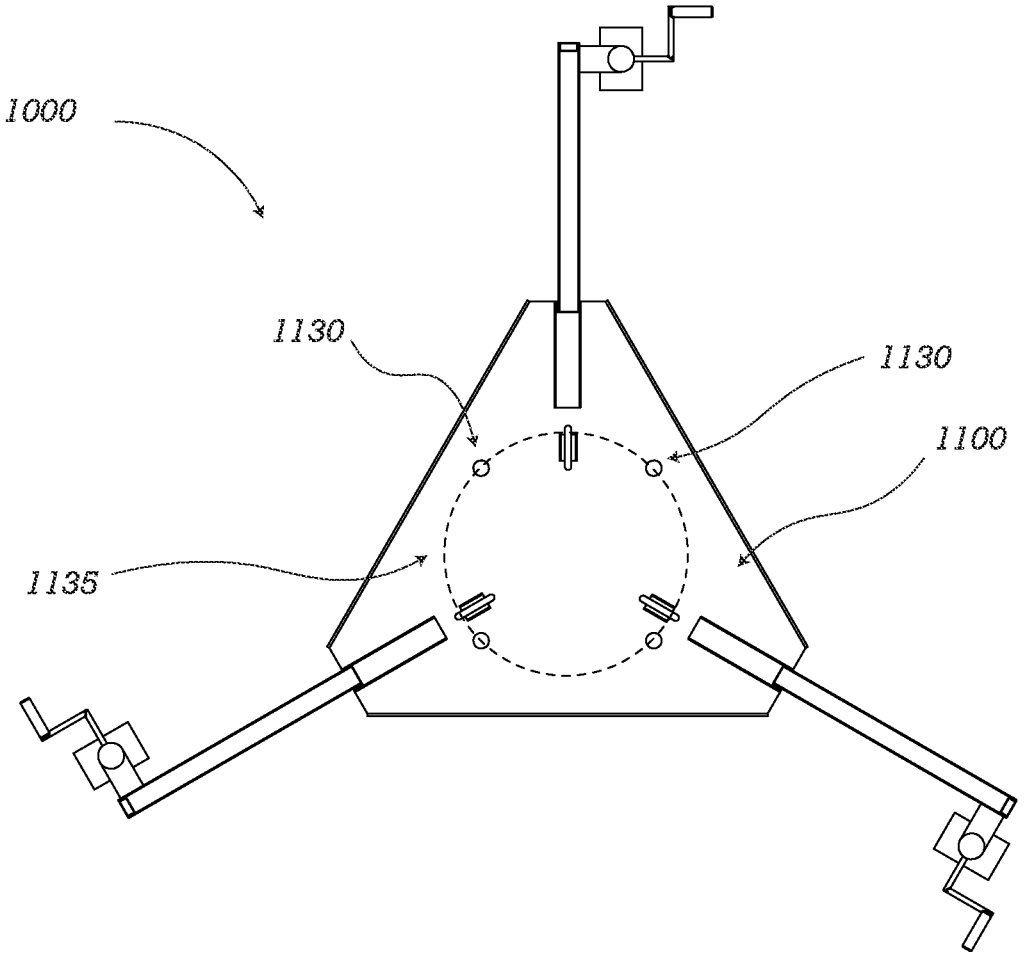
Figure 4:
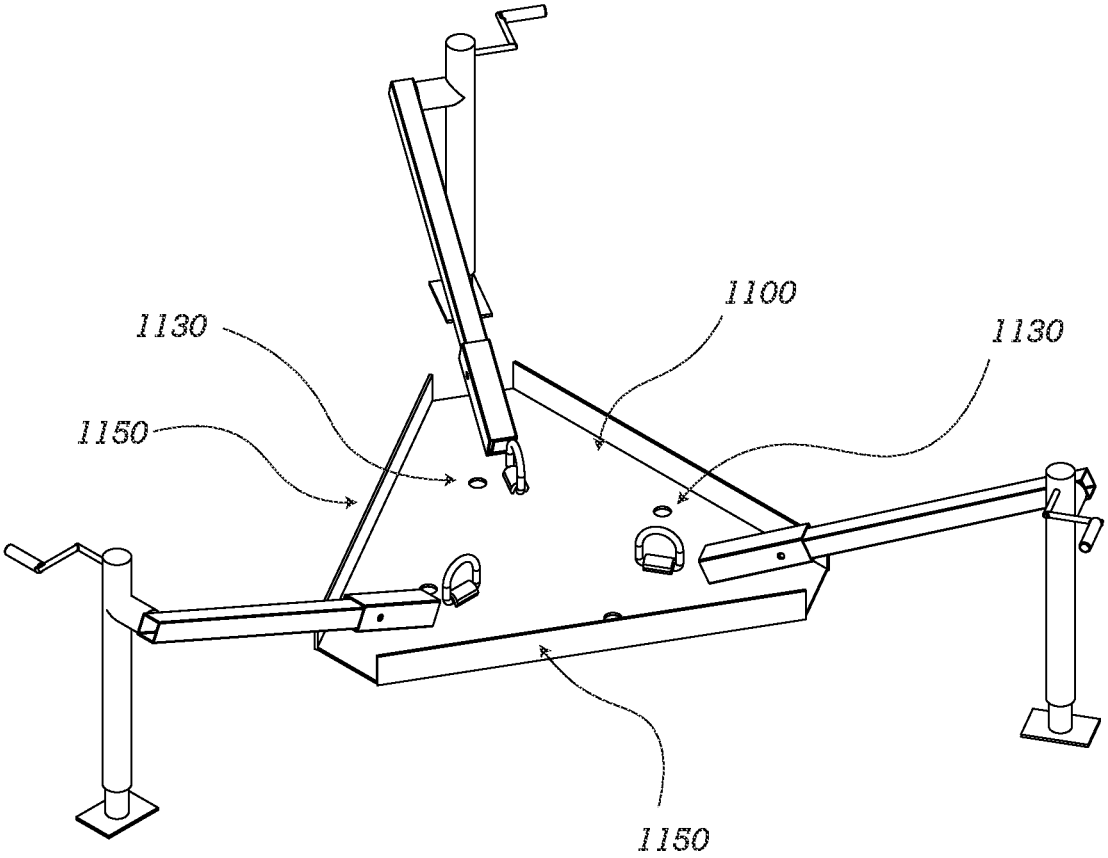

In certain embodiments, as shown in FIG. 3-FIG. 4 for example, the base-plate 1100 comprises a generally triangular shape with flanges 1150, such as upturned or downturned edges, which act to increasing planar rigidity of the base-plate 1100. In alternative embodiments, the base-plate 1100 may comprise a perimeter frame. While embodiments shown herein comprise a triangular shaped base-plate 1100, alternate embodiments comprising a base-plate with alternate shapes such as circular, square, rectangular, oval, hexagonal, octagonal, polygonal, curvilinear, or other shapes are within the spirit and scope of the present invention.

Figure 5A:
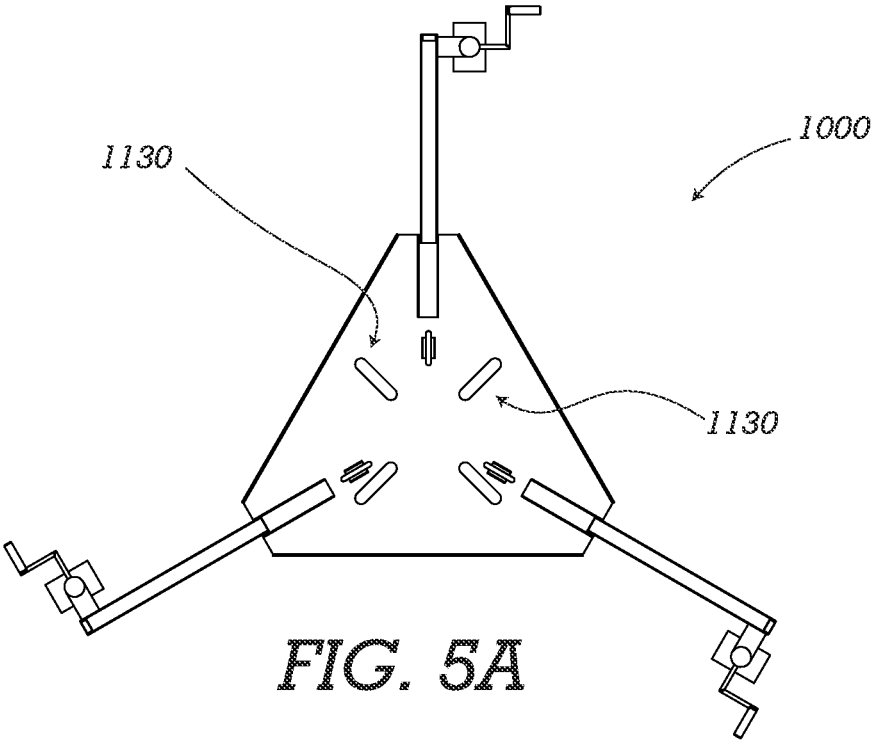
Figure 5B:
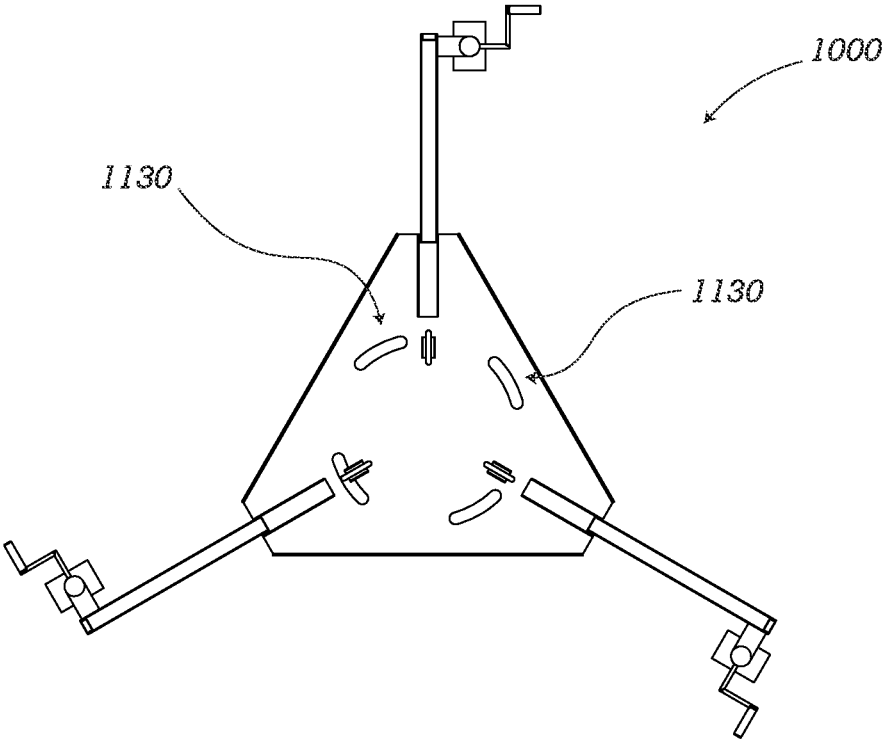

In certain embodiments, as shown in FIG. 5A-FIG. 5B it may be desired for the apertures 1130 of the baseplate to comprise a slotted profile wherein the slotted apertures 1130 are configured to interconnect with a variety of mounting flanges or surfaces having differing bolt circle diameters, such as shown in FIG. 5A, or wherein the slotted apertures 1130 are configured to interconnect a mounting flange or mounting surface in a variety of rotational orientations as shown in FIG. 5B.

Figure 5C:
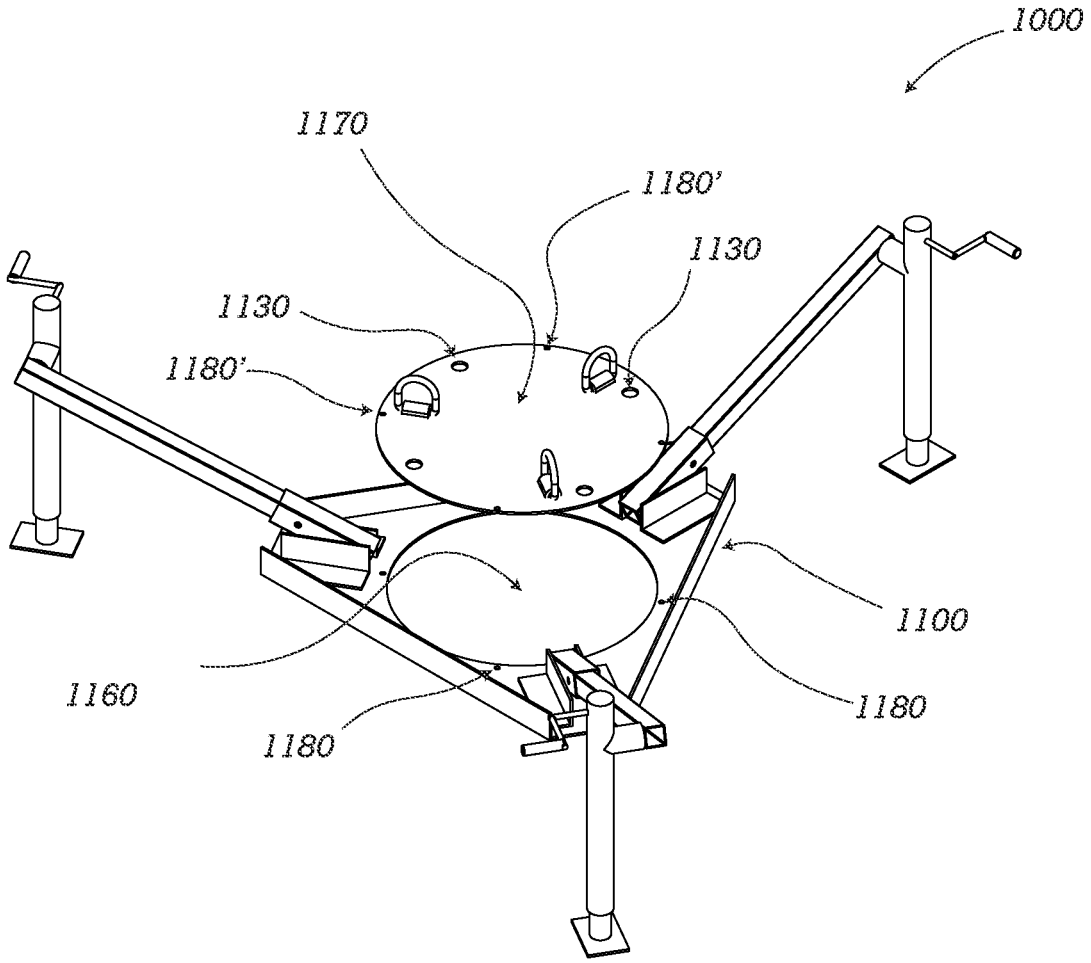

In further embodiments still, as shown in FIG. 5C for instance, it may be desired for a base-plate 1100 to have an open central aspect 1160 wherein base-plate 1100 is configured to receive any one of a number of adaptor plates 1170 thereto, wherein alternate adaptor plates 1170 comprise apertures 1130 with alternate bolt circle diameters and/or different bolt patterns for interconnecting with. In such embodiments, adaptor apertures 1180 through the baseplate 1100, and adaptor apertures 1180' through the adaptor 1170 are used for interconnecting the adaptor plate 1170 to the base-plate 1100, and apertures 1130 through the adaptor 1170 are configured for interconnecting with the fastening features of the mounting flange or mounting surface. In certain embodiments, the adaptor plate 1170 is adapted to interconnect to a bottom aspect of the base-plate 1100 to allow for adaptor plate 1170 to be attached to mounting flange or mounting surface 9100 before attachment to the base-plate 1100. For example, in certain embodiments, adaptor plate 1170 is attached to fastening features 9130 during fabrication of the utility anchor 9000 and may be used to align the fastening features 9130 in order to form the mounting flange or mounting surface 9100. The utility anchor 9000 with the pre-attached adaptor plate 1170 is then transported to the installation location where base-plate 1100 is then interconnected to adaptor plate 1170.

In certain embodiments, adaptor plate 1170 comprises an elevation adjustment aspect to allow for an offset relationship between the mounting flange or mounting surface 9100 and base-plate 1100. For example, adaptor plate 1170 may comprise a bracket that allows for the attached utility anchor 9000 to hang a predetermined distance lower than if it was attached to or proximal to base-plate 1100. In one such embodiment, adaptor plate 1170 comprises an offset distance of 12 inches, 18 inches, 24 inches, or 36 inches. In another such embodiment, the offset distance of the adaptor plate 1170 is adjustable.

Figure 6:
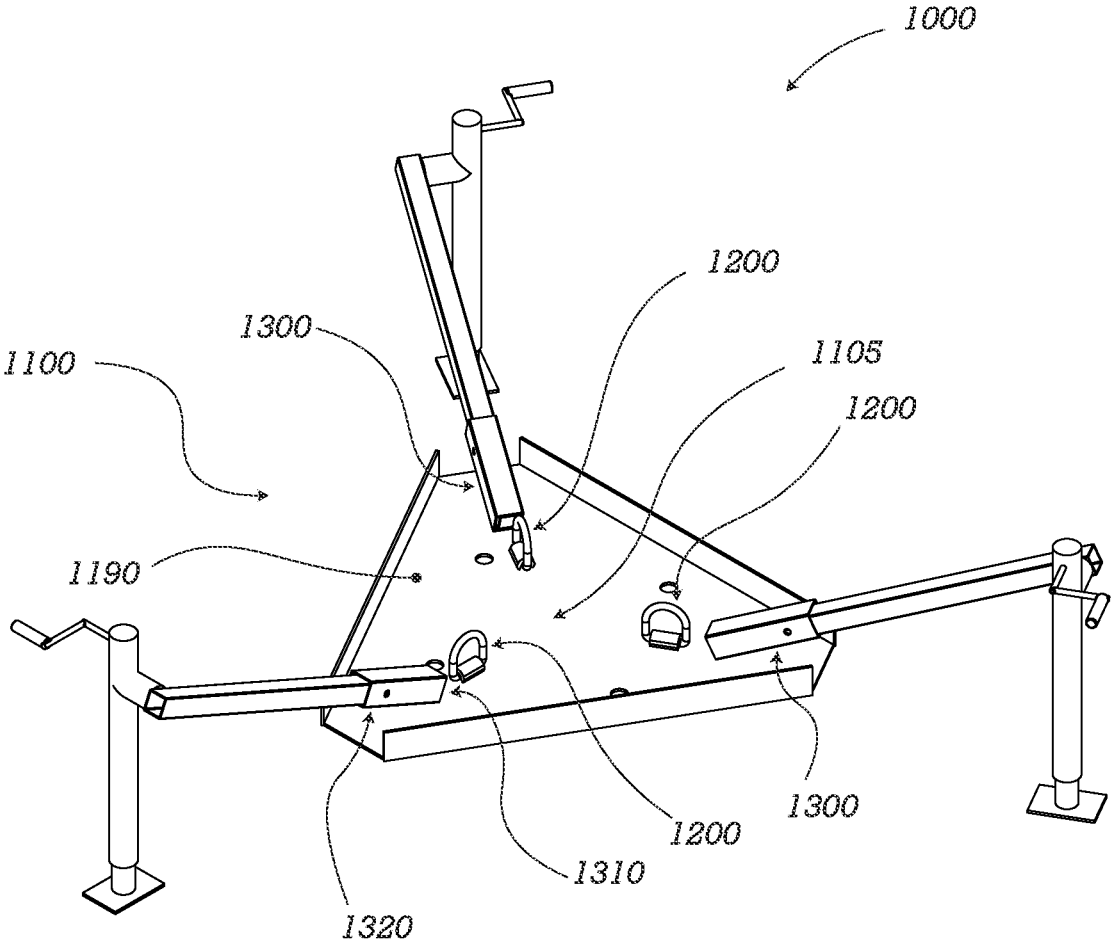

Embodiments shown herein, such as those pictured in FIG. 6 for example, comprise D-ring tethering points, however alternate embodiments comprising tie-downs, webbing guides, webbing plates, shackles, anchor points, or other tethering points are within the spirit and scope of the present invention. Furthermore, embodiments comprising apertures configured to receive a tether such as a rope, webbing, cable, chain, lifting hooks, lifting shackles, or other lifting accessories therethrough for the purposes of lifting are within the spirit and scope of the present invention. For example, in certain embodiments, the flanges 1150 comprise one or more through holes for attachment of lifting accessories.

Certain embodiments of the present invention, as shown in FIG. 6 for example, comprise a bracing apparatus 1000 comprising a baseplate 1100 with a plurality of receivers 1300 connected thereto. In certain embodiments, the baseplate 1100 comprises three receivers 1300, each radially offset from a central aspect 1105 of the baseplate and wherein each receiver 1300 is angularly offset from each other. As shown, the receivers 1300 are generally equally radially offset from the central aspect 1105 and angularly equally offset from each other, however embodiments of the present invention are not limited thereto.

In certain embodiments of the present invention the receivers are interconnected to the baseplate 1100 with the receiver 1300 aligned with a first proximal end 1310 directed inward toward a central aspect 1105 of the baseplate, and a distal second end 1320 directed away from the central aspect 1105 of the base-plate. In certain embodiments the distal end of the receiver comprises an angle 1325 wherein the second end 1320 is directed upward and away from the central aspect 1105 of the base-plate. While it is preferred for the second end 1320 of the receiver to be angled upward and away from the central aspect 1105 of the base-plate in certain embodiments, alternative embodiments wherein the receiver 1300 is oriented parallel the top surface 1190 of the base-plate, or embodiments wherein the receiver is angled downward and away from the top surface 1190 of the base-plate are within the spirit and scope of the present invention.

Figure 7A:
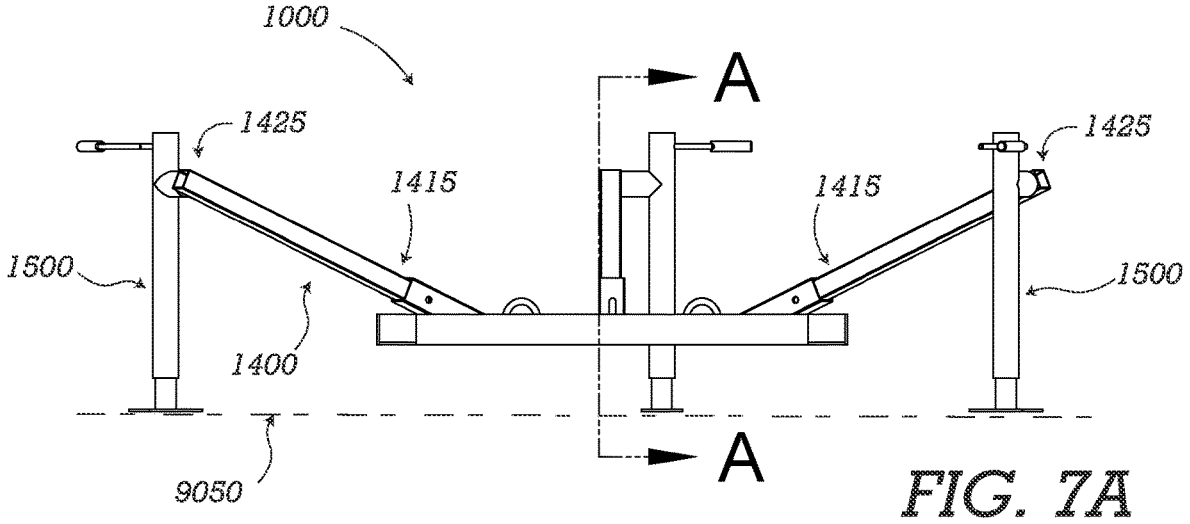
Figure 7B:
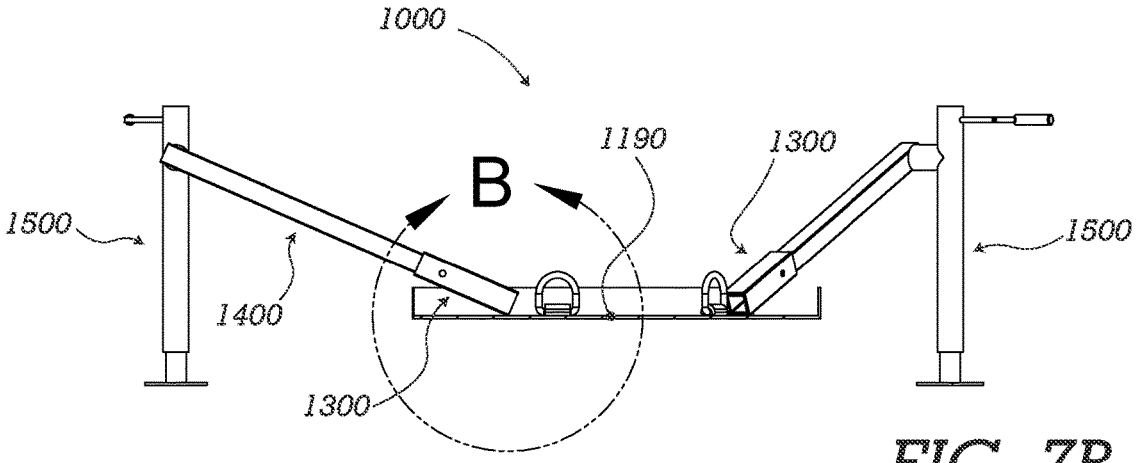
Figure 7C:
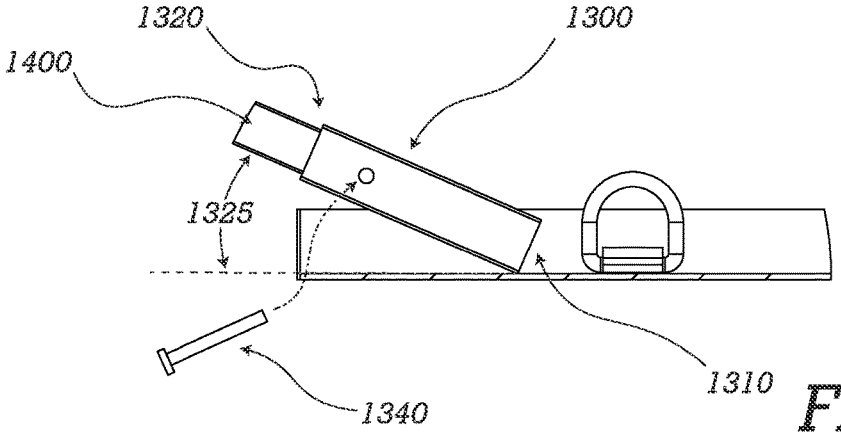
Figure 8:
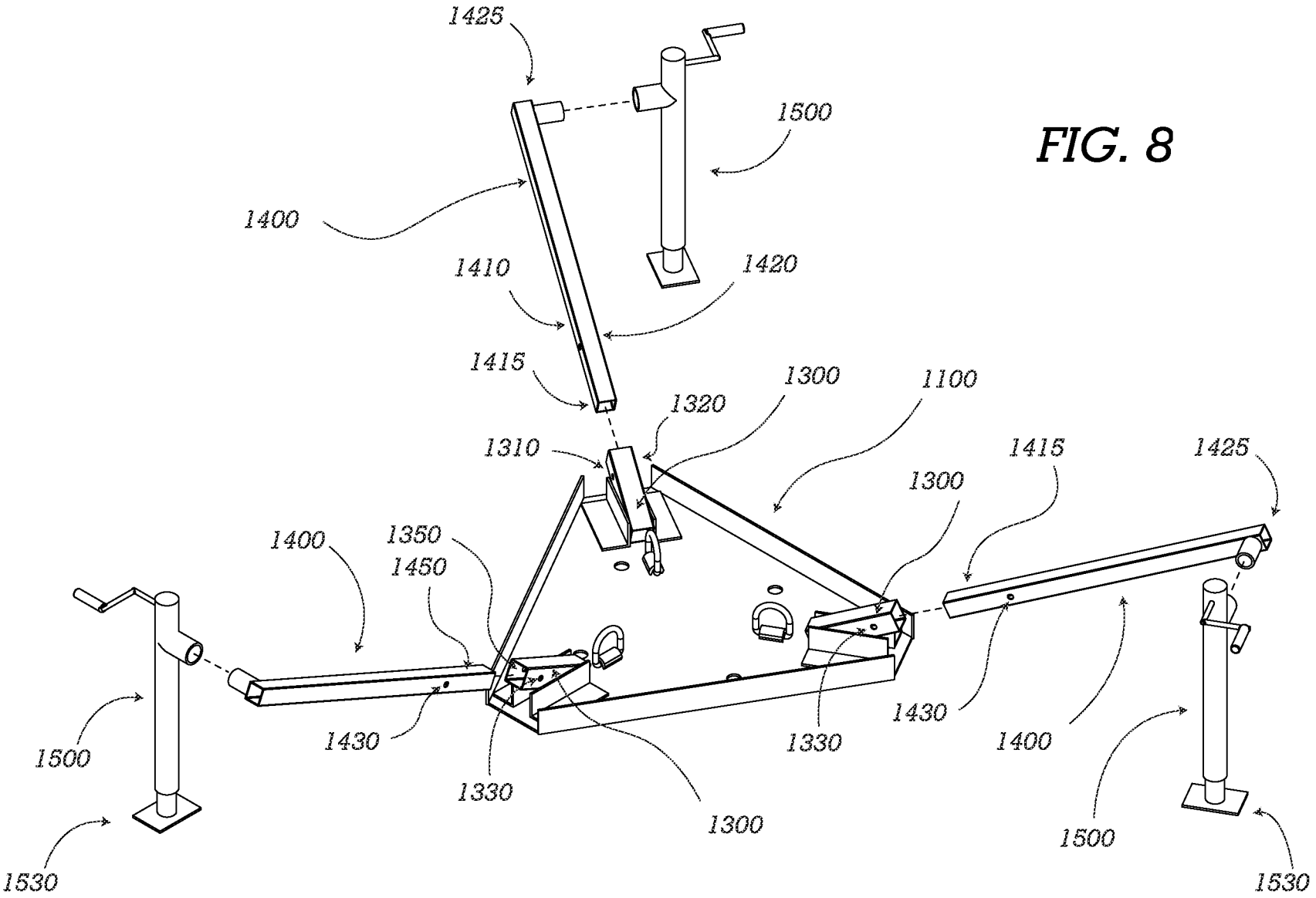

In certain embodiments, as shown in FIG. 7A-FIG. 8 for example, a receiver 1300 is configured to be angularly adjustable in relation to the base-plate wherein the first end 1310 of the receivers is hingedly interconnected with the base-plate 1100 and the second end 1320 is configured to be constrained in at least one angular orientation in relation to the base-plate 1100. Embodiments wherein the receiver 1300 is configured to be constrained to angles between 0 degrees and 90 degrees from the top aspect of the base-plate 1100 are within the spirit and scope of the present invention.

In certain embodiments, as shown in FIG. 7A-FIG. 8 for example, the receivers 1300 are adapted for slidably receiving an arm 1400 therein, wherein the arm 1400 extends generally radially outward from the base-plate 1100. While embodiments show the receiver 1300 as tubular form having a square profile, alternate embodiments wherein the receiver 1300 comprises a tubular form with a rectangular profile, rounded profile, curvilinear profile, or other polygonal profile are within the spirit and scope of the present invention.

Certain embodiments of the present invention comprise a bracing apparatus 1000 comprising receivers 1300 configured for slidably receiving arms 1400 within an inner aspect of the receivers. In certain embodiments the arms 1400 comprise an outer profile 1450 matching the inner profile 1350 of the receivers wherein the arms are configured to slidably insert within the inner aspect 1350 of a receiver. In certain embodiments a receiver 1300 comprises a cross-drilled hole 1330 extending through a first side 1310 of the receiver and extending through a second side 1320 of the receiver. Furthermore, the arm 1400 comprises a cross-drilled hole 1430 extending through a first side 1410 of the arm and through a second side 1420 of the arm, wherein the cross-drilled hole 1430 of the arm is configured to align with the cross-drilled hole 1330 of the receiver when the arm 1400 is slidably axially inserted within the receiver 1300. The aligned cross-drilled holes are thereby configured to receive a clevis pin 1340 therethrough to constrain the arm to the receiver. While clevis-pins 1340 are disclosed herein, the use of alternate shear loading devices such as linchpins, quick release pins, bolts and the like are within the spirit and scope of the present invention.

Furthermore, alternate embodiments wherein the receiver 1300 comprises an open side such as found with a C-channel, wherein the open profile is configured to receive an arm laterally through the open aspect and constrained in place with a clevis pin or other shear loading device are within the spirit and scope of the present invention.

In certain embodiments, as shown in FIG. 7A-FIG. 8 for example, an arm 1400 is configured to extend from a first end 1415 configured to slidably interconnect with a receiver 1300, to a second end 1425 configured to interconnect with a jack 1500. A "jack" as used herein refers to its common and ordinary meaning surrounding a device for lifting objects. Furthermore, a "jack" as used herein extends to a device configured to raise or lower an object through mechanical strategies. Such mechanical strategies include machines such as a lever and pawl system, screw drive mechanism, scissor jack mechanism, geared mechanism, hydraulically actuated systems, pneumatically actuated systems, electrically actuated mechanisms, manually actuated systems, and other mechanical systems configured to raise and lower an object. The second end 1425 of the arm is configured to interconnect with a jack 1500 wherein the raising and lowering of the jack 1500 is configured to raise and lower the first end 1415 of the arm and thereby raise and lower the base-plate 1100, and any utility anchor interconnected thereto.

In certain embodiments the second end 1425 of an arm is pivotally interconnected with a jack 1500 although embodiments of the present invention are not limited thereto. Furthermore, in certain embodiments it may be desired for the arm to interconnect with a jack between the first end 1415 and the second end 1425 of the arm rather than at a distal end as pictured. For instance, in certain embodiments an arm may comprise a plurality of interconnection points to allow a user to interconnect a jack 1500 to the arm 1400 thereto as desired to allow for adapting the bracing apparatus to the environment in which the bracing apparatus 1000 is used. For instance, it may be desired for a jack 1500 to be interconnected closer to the first end 1415 of the arm in the event the ground surface 9050 more proximal to the bracing apparatus is more suitable for the use of a jack. Furthermore, it may be desired in certain scenarios to interconnect a jack 1500 more distally from the bracing apparatus in the event the ground surface proximal to the bracing apparatus is unsuitable for the use of the jack. In certain embodiments, at least one arm 1400 is telescopic to allow for adjustment of the distance of the jack 1500 from the bracing apparatus 1000.

Figure 9A:
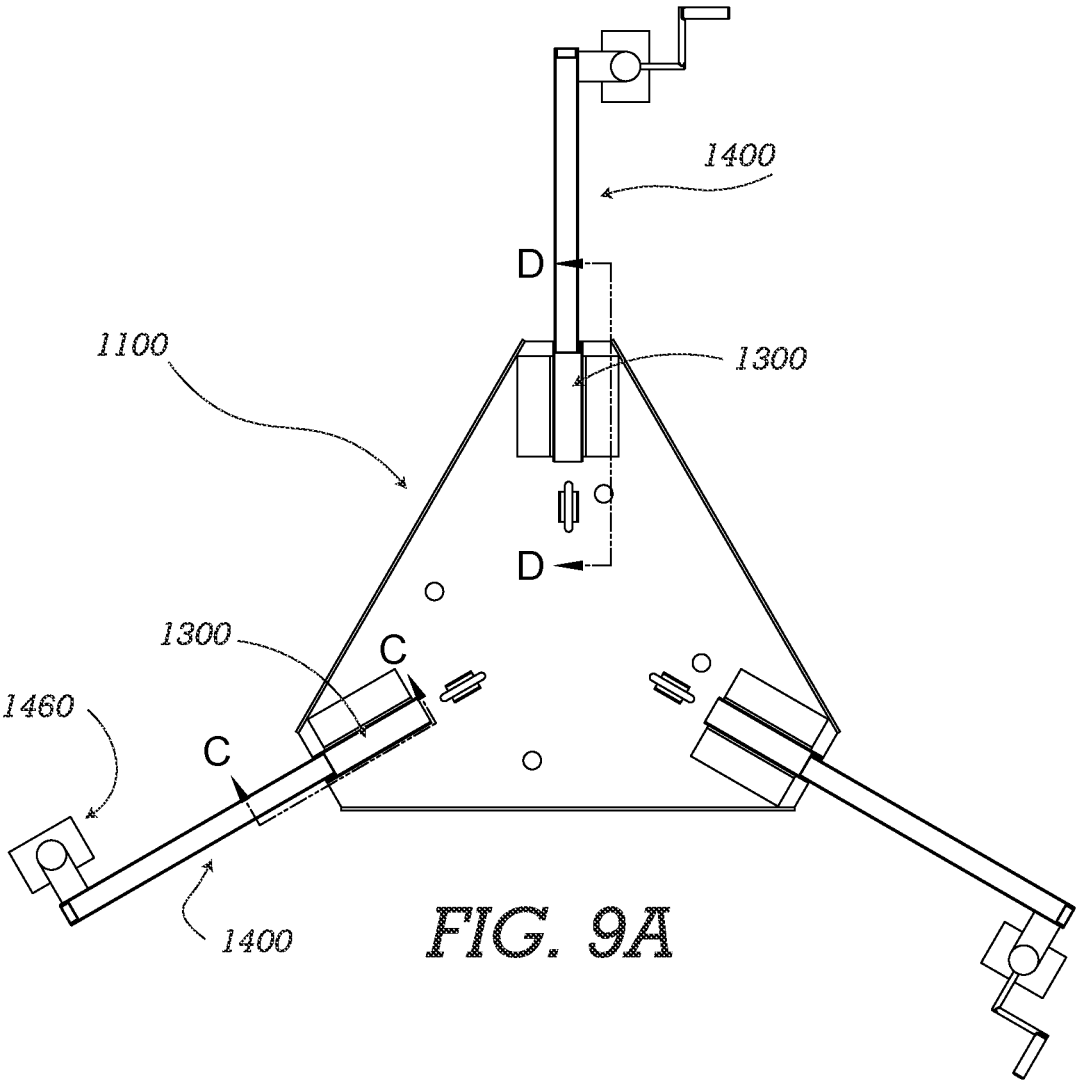
Figure 9B:
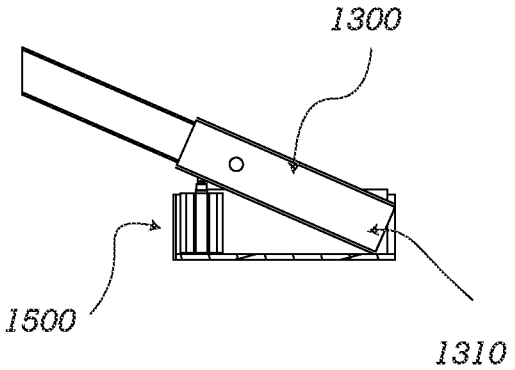
Figure 9C:
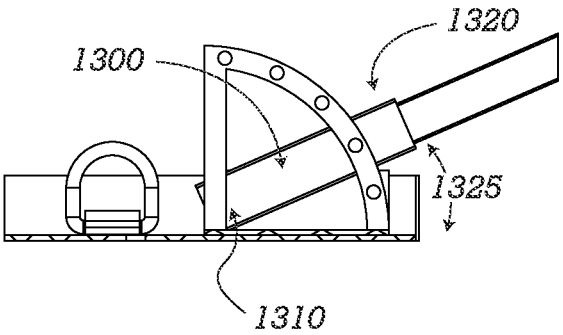

In certain embodiments, as shown in FIG. 9A-FIG. 9C for instance, the jack 1500 is interconnected between the receiver 1300 and the base-plate 1100 wherein the first end of the receiver 1310 (FIG. 9B) is hingedly interconnected with the base-plate 1100 and the jack 1500 is configured to raise and lower the second end 1320 of the receiver in relation to the base-plate 1100. The jack 1500 as shown in FIG. 9B comprises a hydraulically actuated jack. In such embodiments an arm 1400 is interconnected to the receiver 1300 wherein the arm comprises a footplate 1460 configured to bear on the ground surface and the actuation of the jack upwards and downwards results in the raising and lowering of the bracing apparatus 1000.

Furthermore, in certain embodiments (FIG. 9C) the first end 1310 of the receiver is hingedly interconnected to the base-plate 1100, and the second end 1320 of the receiver is configured to be locked in a plurality of predetermined angles 1325 from the base-plate 1100.

Figure 10A:
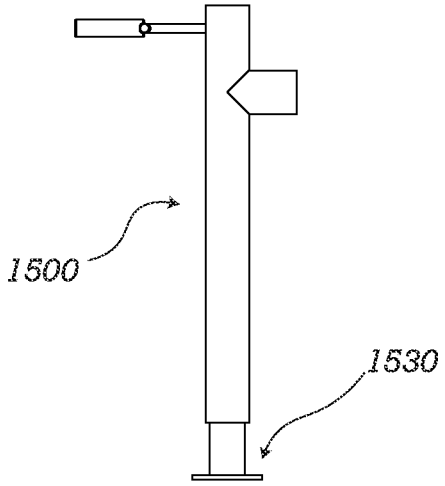
Figure 10B:
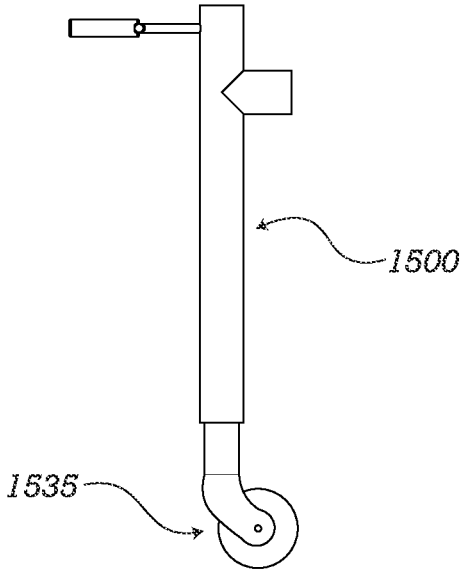

While embodiments shown herein, such as shown in FIG. 10A-FIG. 10B include a jack 1500 comprising a footplate 1530, in certain embodiments it may be desired for the jack 1500 to comprise a roller 1535 to allow the rolling of the jack for lateral adjustment and rotational adjustment of the bracing apparatus. In further embodiments still, it may be desired for the jack 1500 to comprise an element such as a ground-stake, or spike configured to penetrate the ground surface for further purchase and stability when the bracing apparatus is used.

Figure 11A:
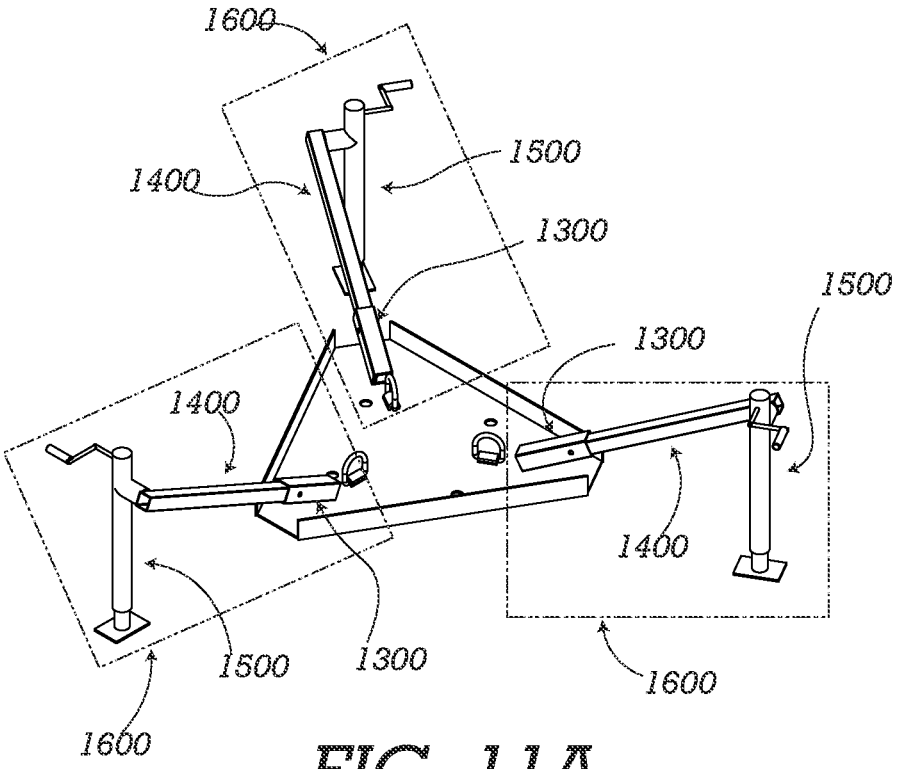
Figure 11B:
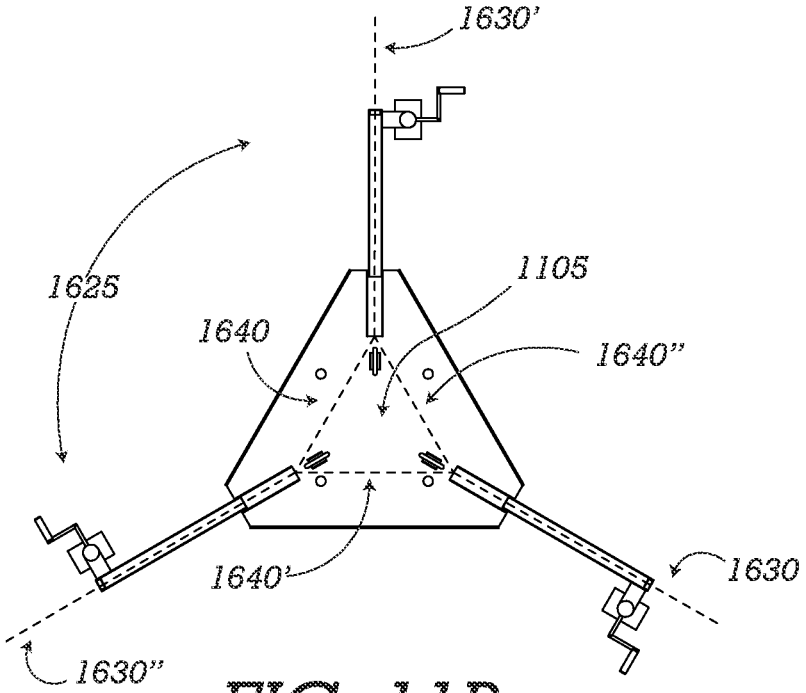

In certain embodiments, as demonstrated in FIG. 11A-FIG. 11B for example, a bracing apparatus 1000 comprises three leveling assemblies 1600, wherein each leveling assembly comprises a receiver 1300, an arm 1400 interconnected to the receiver 1300, and a jack 1500 interconnected with the arm 1400. The leveling assemblies 1600 are angularly offset 1625 from each other by about 120-degrees to allow for efficient adjustment of the bracing apparatus. For instance, when the three leveling assemblies are offset by about 120-degrees, the leveling axis 1630 of a first leveling assembly acts perpendicularly to the axis 1640 running between the second leveling assembly and the third leveling assembly.

While embodiments shown herein comprise leveling assemblies which are radially oriented toward a central aspect 1105 of the base-plate, alternate embodiments wherein the arms are non-radially oriented are within the spirit and scope of the present invention. For instance, it may be desired for the arms to be tangentially oriented in relation to a central aspect 1105 of the base-plate. In certain embodiments the angular orientation of the arms are adjustable and allow for the arms to be angularly adjusted or folded inward for storage purposes. For example, in certain embodiments, arms 1400 are hingedly interconnected to base-plate 1100 so that the arms 1400 may be folded into a compact position for transportation or storage of the bracing apparatus 1000.

Figure 12A:
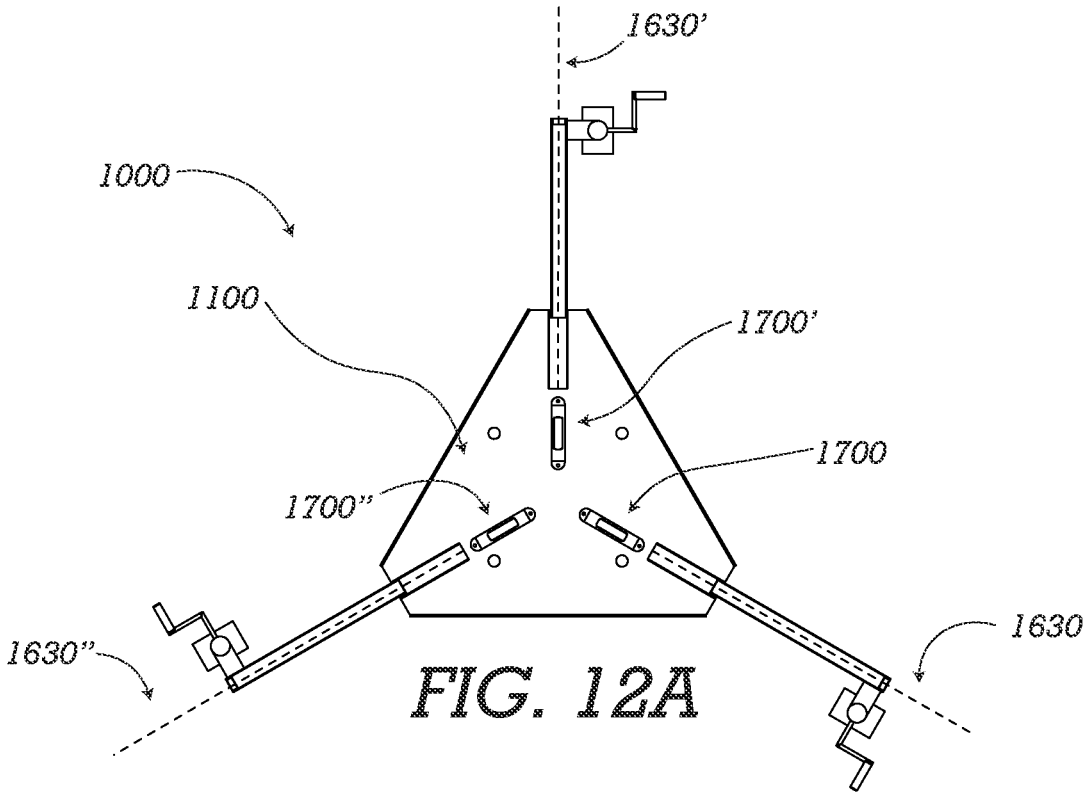
Figure 12B:
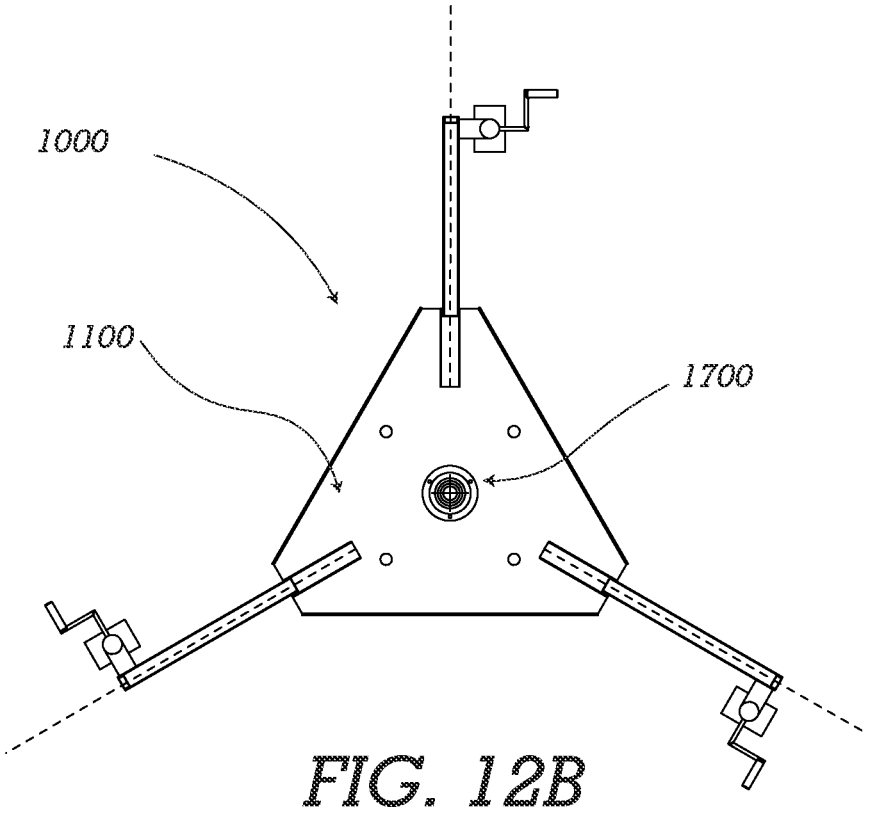

Certain embodiments of the present invention, shown in FIG. 12A-FIG. 12B for instance, comprise a level indicator 1700 to communicate with a user that the bracing apparatus is either level or out of level. In certain embodiments a single plane level, such as a spirit level, allow a user to understand the orientation of the base-plate and thus the orientation of the bracing apparatus in relation to a horizontal plane. In certain embodiments a singular level is used wherein the level is moved around in relation to the leveling axis 1630 of each leveling assembly 1600. In certain embodiments, a level is interconnected parallel to the leveling axis of a leveling assembly, and in certain embodiments a level indicator 1700 interconnected parallel to the leveling axis of each leveling assembly. In further embodiments a multi-plane level, such as a surface mount circular level, cardan level, or all-way level is interconnected to the base-plate 1100 of the bracing apparatus. A multi-plane level 1700' allows a user to understand the orientation of the bracing apparatus 1000 in relation to a horizontal plane. Furthermore, understanding the orientation of the bracing apparatus 1000 in relation to a horizontal plane further indicates the orientation of any utility anchor interconnected thereto in relation to a vertical orientation. In certain embodiments a level indicator 1700 comprises a level sensor such as an accelerometer having a singular axis or a plurality of axes.

In certain embodiments the bracing apparatus 1000 comprises a controller 2000 with a power supply 2100 wherein the controller 2000 is interconnected with at least one level sensor 1700 interconnected with the bracing apparatus 1000. The level sensor(s) 1700 provide data to the controller 2000 in relation to the orientation of the bracing apparatus 1000, and the controller 2000 provides signals to actuate one or more jacks 1500 with commands for actuation to raise or lower to approach a level orientation of the bracing apparatus 1000. In certain embodiments controller 2000 further comprises connection with an elevation indicator which provides the controller with elevation information. Elevation information as discussed herein includes the elevation of the apparatus above a ground surface in certain embodiments, while in alternate embodiments the elevation information is relative to a reference plane located away from the bracing apparatus. In certain embodiments controller 2000 is adapted to control the jacks 1500 so that, after the bracing apparatus 1000 is leveled, the jacks 1500 may be raised or lowered generally simultaneously to adjust the elevation of the mounting flange or mounting surface 9100 relative to the ground or grade level while maintaining the bracing apparatus 1000 in a leveled orientation.

Figure 13:
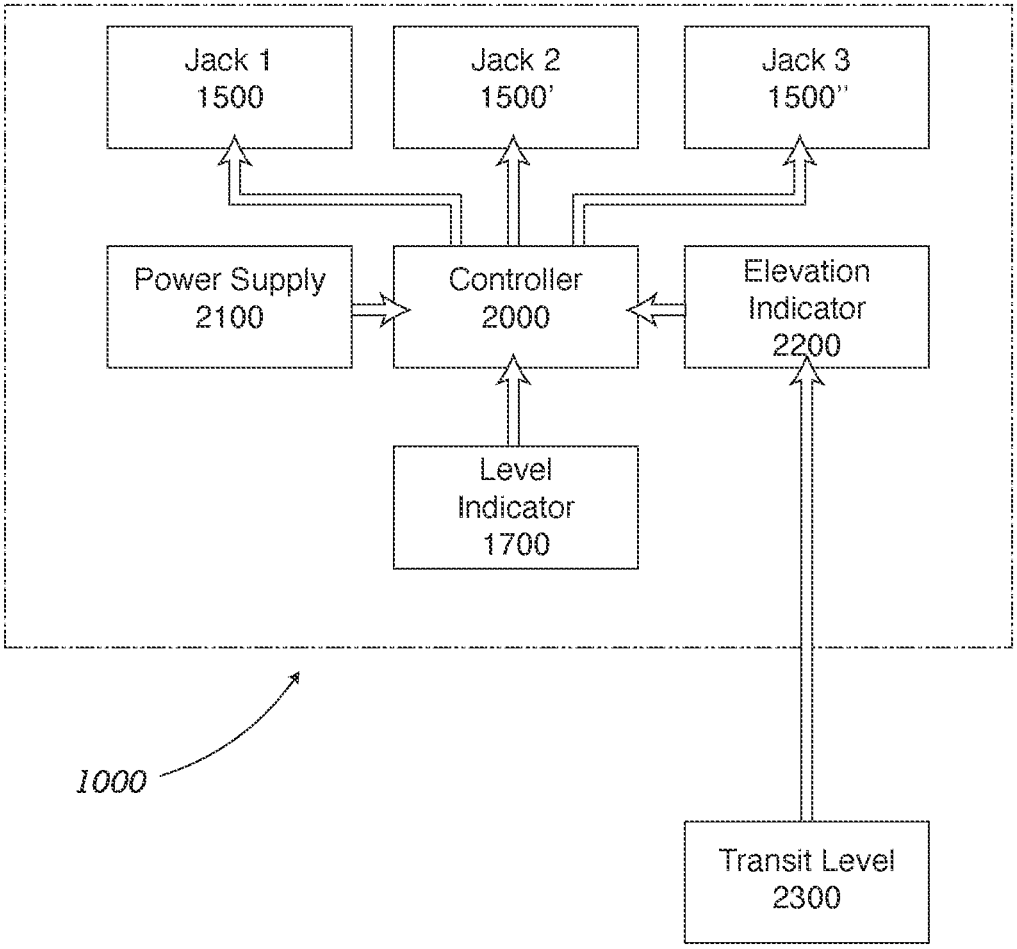

In certain embodiments, as shown in FIG. 13 for instance, elevation information can be provided using a transit 2300 wherein a transit level 2300 is located at a reference location which provides a reference elevation for the mounting flange or mounting surface of the utility anchor. Upon establishing a reference location, a calibrated rod is placed referencing the mounting flange or mounting surface to allow the reading of the elevation of the mounting flange or mounting surface in relation to the reference elevation, thus providing a relative elevation. Upon determining a relative elevation, the bracing apparatus 1000 can be used to raise or lower the mounting flange or mounting surface through actuation of one or more jacks 1500 of the utility anchor until it is to a desired elevation in relation to the reference elevation. In certain embodiments the relative elevation derived from the transit 2300 is communicated to the controller (through manual input, wireless communication protocols, or wired communication protocols) wherein the controller then actuates the jacks 1500 accordingly to establish the mounting flange or mounting surface 9100 at the desired relative elevation in relation to the reference elevation.

Figure 14:
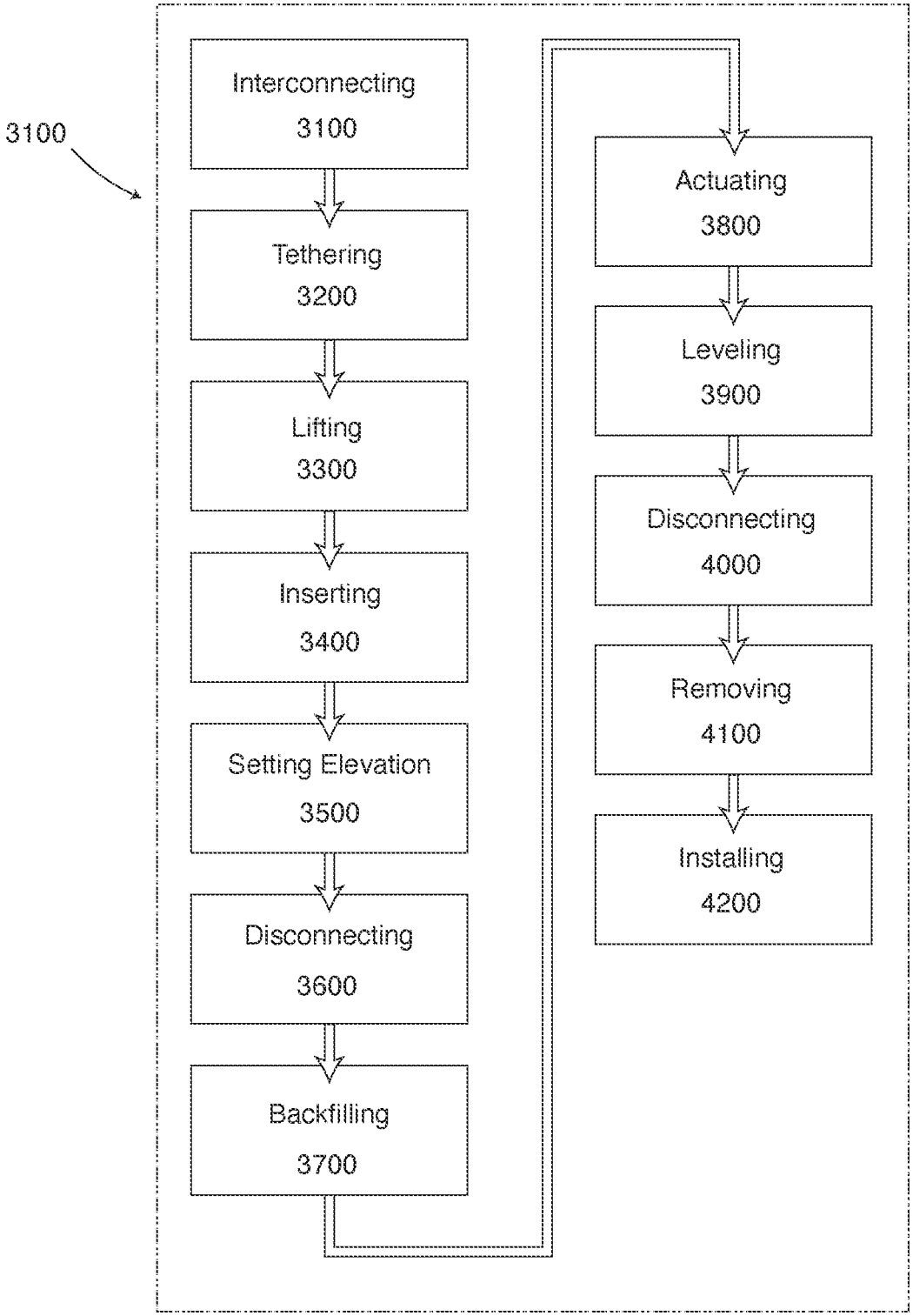

Certain embodiments of the present invention, such as shown in FIG. 14 for instance, surround a process 3000 for installing a utility anchor with a bracing apparatus as described herein, the bracing apparatus 1000 is interconnected with the mounting flange or mounting surface 9100 in an interconnecting step 3100. The interconnecting step 3100 surrounds the constraint of the bracing apparatus 1000 to the mounting flange or mounting surface 9100, often with bolts, nuts, screws, or other hardware associated with the mounting flange or mounting surface 9100. While the bracing apparatus 1000 of certain embodiments is directly interconnected to the mounting flange or mounting surface 9100, it may be desired to have an intermediate layer, gasket, or adaptor therebetween. A utility anchor is often transported to the installation location aboard a vehicle or trailer in a horizontal orientation, as such interconnecting 3100 the bracing apparatus to the mounting flange or mounting surface of the utility anchor while the utility anchor is in a horizontal orientation may be desired. Following the interconnecting step 3100 is the tethering step 3200 wherein tethers are interconnected to the tethering points of the bracing apparatus to prepare for lifting the assembly of the bracing apparatus and the utility anchor assembly. Following the tethering step 3200, a lifting step 3300 occurs wherein the bracing apparatus and utility anchor assembly is lifted, and the bottom aspect of the utility anchor is inserted 3400 into a prepared hole wherein the utility anchor is to be installed. Setting the desired elevation 3500 for the flange or surface mount in relation to grade or to a reference elevation can be done prior to inserting 3400 the utility anchor within the prepared hole, while the utility anchor is suspended within the prepared hole with the lifting equipment or after disconnecting 3600 the lifting equipment from the bracing apparatus. In certain embodiments it may be desired to backfill 3700 the hole with fill or aggregate which establishes a desired depth to match a desired mounting flange or mounting surface height. In alternate embodiments it may be desired to backfill 3700 the prepared hole while the utility anchor is suspended within the hole with the lifting equipment. In further embodiments still it may be desired to actuate the jacks 3800 to support the utility anchor at a desired height prior to disconnecting 3600 the lifting equipment from the bracing apparatus. Even further still, in certain embodiments it may be desired to disconnect 3600 the lifting equipment from the bracing apparatus and establish a desired height after disconnecting 3600 the lifting equipment. After the utility anchor is inserted 3400 within the prepared hole, the jacks are actuated 3800 to establish a desired elevation 3500 and to level 3900 the base-plate and thus the mounting flange or mounting surface of the utility anchor. Actuating 3800 of the jacks are done selectively to approach and reach a state of level 3900. In certain embodiments a user selectively actuates 3800 one or more jacks after determining through inspection of a leveling indicator if a jack is required to move upward or downward to approach level 3900. The process of actuating 3800 one or more jacks is repeated until a state of level is reached 3900. In certain embodiments comprising a controller, instructions are provided to the user to selectively raise or lower one or more individual jacks 3800 to approach level until a state of level is detected and communicated with the user though visual or audible cues. Furthermore, in certain embodiments a controller selectively actuates one or more jacks 3800 to approach level until a state of level is detected 3900. Once the state of level is detected, the controller communicates to a user that the leveling process is complete. After the leveling step, the prepared hole is filled 3700 around the utility anchor. In certain scenarios it may be desired to partially backfill the prepared hole prior to leveling to establish a desired elevation 3500, and further backfill 3700 the prepared hole following the leveling step 3900. In certain embodiments the prepared hole is filled 3700 around the utility anchor using aggregate material. Furthermore, in certain embodiments the prepared hole is filled 3700 around the utility anchor using concrete. In further embodiments still, the prepared hole is filled 3700 around the utility anchor using expanding structural foam, such as a polyurethane foam. Once the filling step is complete and the utility anchor is stable in its final position, the bracing apparatus is disconnected 4000 from the mounting flange or mounting surface of the ground anchor, and the lifting assembly is then removed 4100 from the mounting flange or mounting surface by lifting it away to allow for installation 4200 of the above-ground infrastructure to the mounting flange or mounting surface.

Figure 1A:
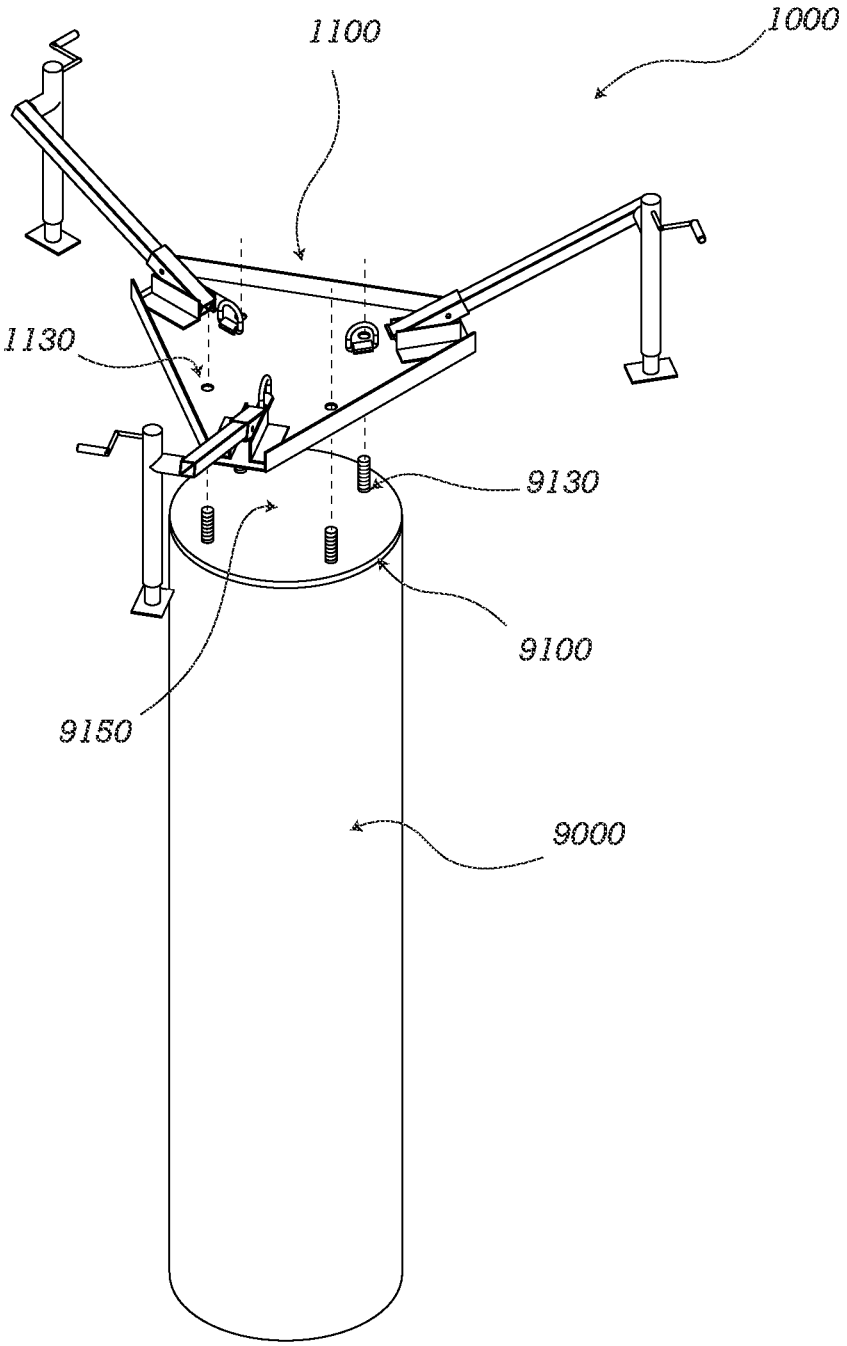
FIG. 1A—An exploded perspective view of certain embodiments of the present invention FIG. 1B—An exploded side view of certain embodiments of the present invention FIG. 2—A top view of a mounting flange or mounting surface of a utility anchor FIG. 3—A top view of certain embodiments comprising a bracing apparatus FIG. 4—A perspective view of certain embodiments comprising a bracing apparatus FIG. 5A—A top view of certain embodiments comprising a bracing apparatus FIG. 5B—A top view of certain embodiments comprising a bracing apparatus FIG. 5C—A perspective view of certain embodiments comprising a bracing apparatus FIG. 6—A perspective view of certain embodiments comprising a bracing apparatus FIG. 7A—A side view of certain embodiments comprising a bracing apparatus FIG. 7B—A section view of the embodiment shown in FIG. 7A FIG. 7C—A detail view of the section view shown in FIG. 7B FIG. 8—An exploded perspective view of certain embodiments comprising a bracing apparatus FIG. 9A—A top view of certain embodiments comprising a bracing apparatus FIG. 9B—A detail view of the section view shown in FIG. 9A FIG. 9C—A detail view of the section view shown in FIG. 9A FIG. 10A—A side view of a jack as used in certain embodiments of the present invention FIG. 10B—A side view of a jack as used in certain embodiments of the present invention FIG. 11A—A perspective view of certain embodiments comprising a bracing apparatus FIG. 11B—A top view of certain embodiments comprising a bracing apparatus FIG. 12A—A top view of certain embodiments comprising a bracing apparatus FIG. 12B—A top view of certain embodiments comprising a bracing apparatus FIG. 13—A system view of certain embodiments of the present invention comprising a bracing apparatus FIG. 14—A diagrammatic view of a process for installing a utility anchor as described in certain embodiments of the present invention FIG. 15—A perspective view of certain embodiments of the present invention FIG. 16—A perspective view of certain embodiments of the present invention
Figure 1B:
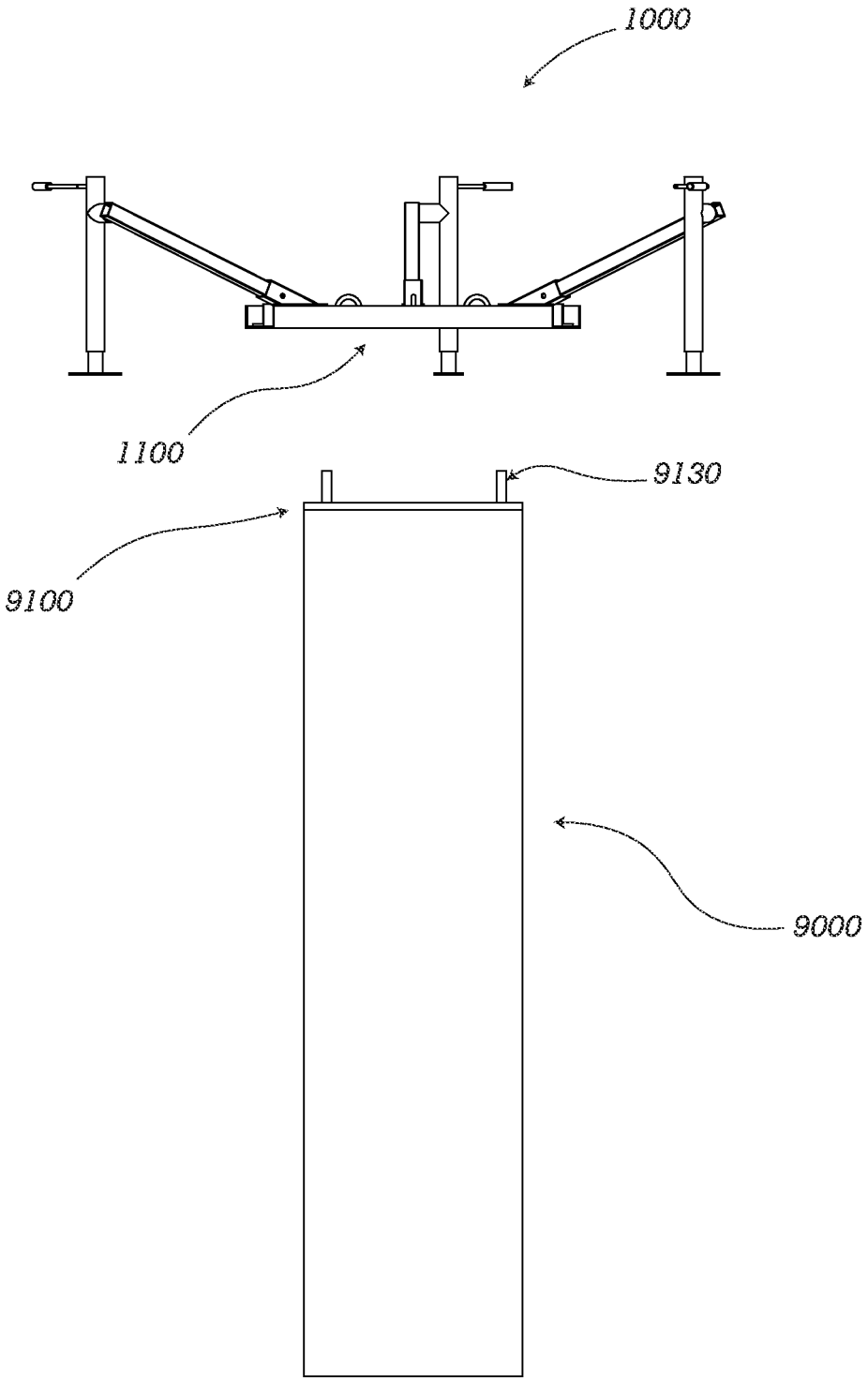
Figure 2:
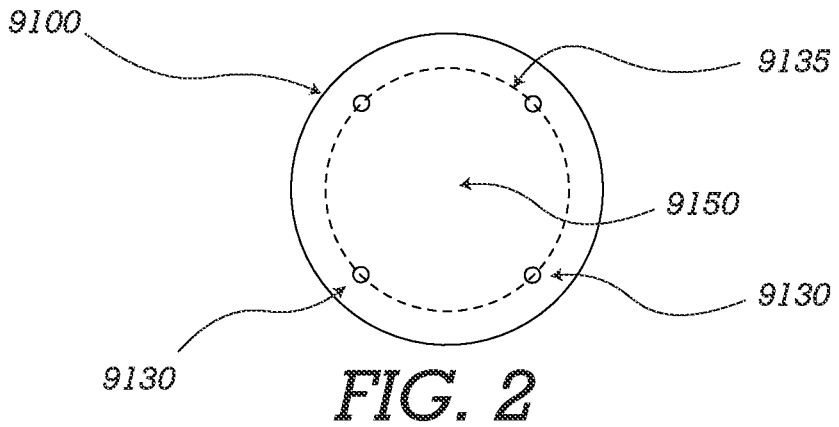
Figure 15:
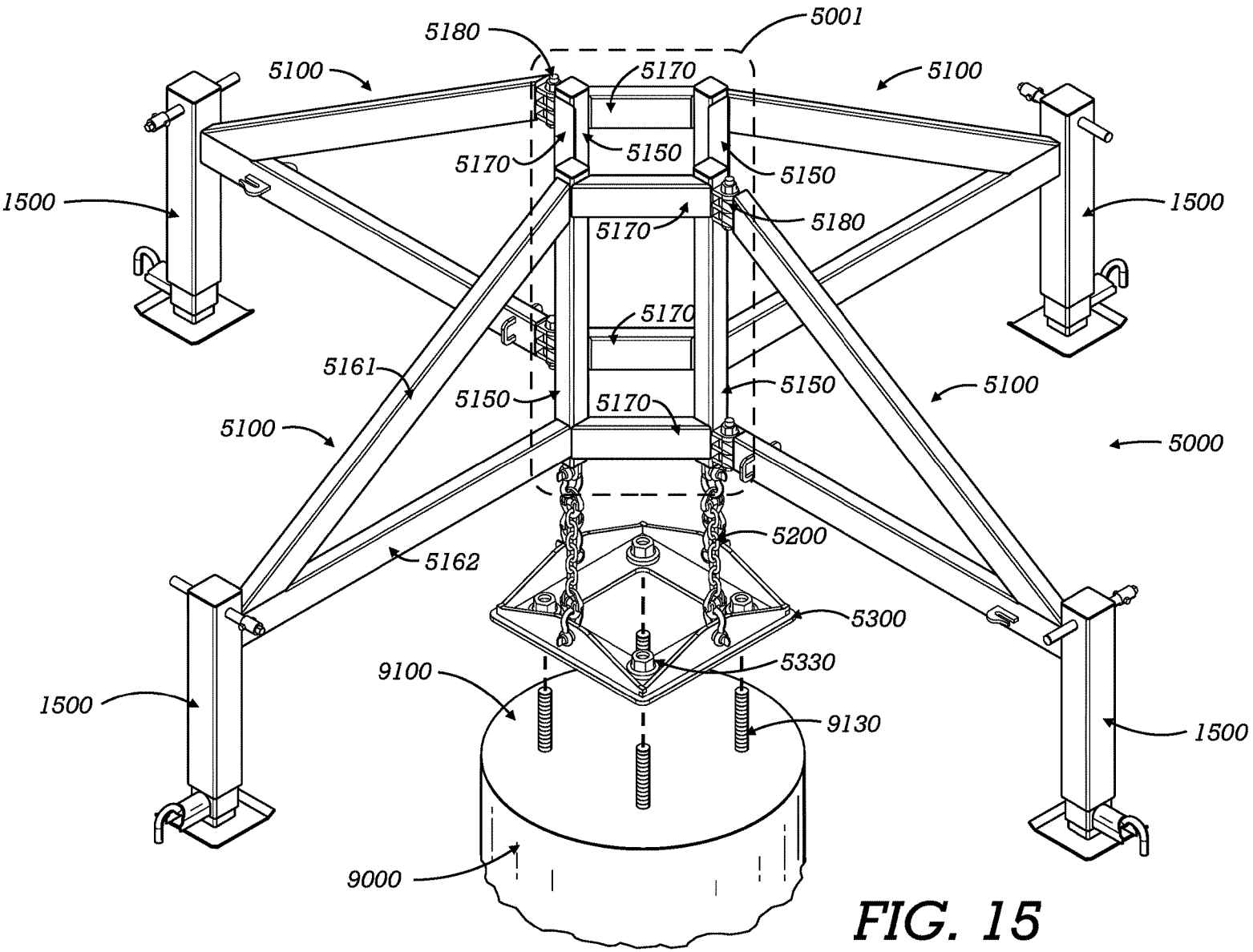
Figure 16:
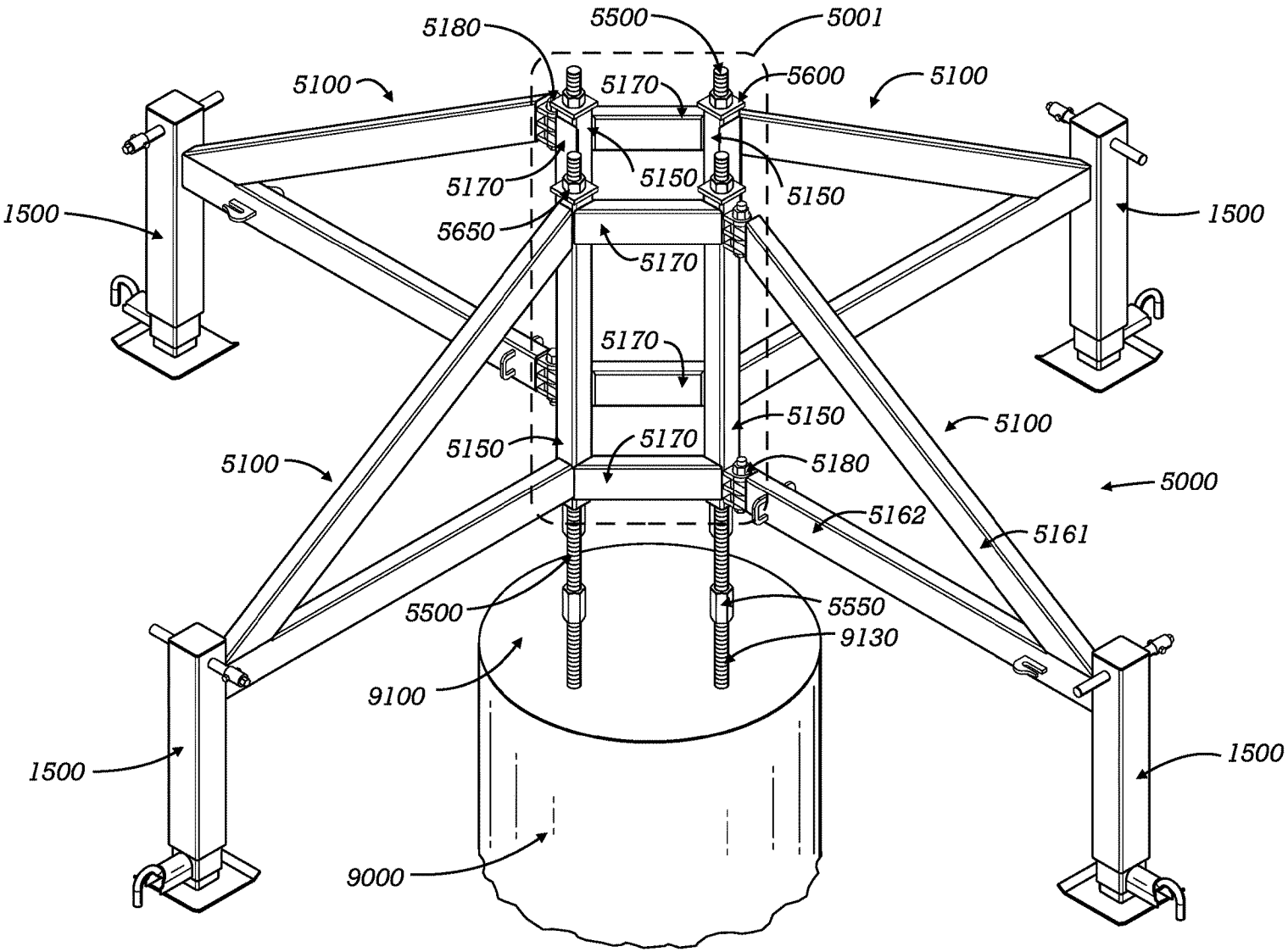

In certain embodiments of the present invention, as shown in FIGS. 15-16, a bracing apparatus 5000 comprises a support pillar 5001 (outlined) and a plurality of support arms 5100. In certain embodiments, the members of bracing apparatus 5000 are steel or aluminum tubes having a square or rectangular cross-section. The support pillar 5001 comprises vertical members 5150 interconnected by connection members 5170 arranged in a rectangular prism configuration. The vertical members 5150 are aligned with the fastening features 9130 of a given mounting flange or mounting surface 9100, typically with a bolt circle diameter 1135 (as shown in FIG. 2). In an alternative embodiment, support pillar 5001 may comprise a single vertical member in the place of the plurality of vertical members 5150 and connection members 5170. In this alternative embodiment, the single vertical member may comprise a square tube having an outer perimeter commensurate to the rectangular cuboid configuration shown in FIGS. 15-16, or a circular tube having a similar diameter. The single member may also have plates interconnected to the top and bottom ends.

In certain embodiments, the bracing apparatus 5000 comprises four support arms 5100, as shown, while other embodiments may comprise three or more than four support arms 5100. Each support arm 5100 comprises an upper member 5161, a lower member 5162, and a jack 1500. However, in an alternative embodiment, support arm 5100 may comprise a single member and a jack 1500. The support arms 5100 are either rigidly interconnected to the support pillar 5001 or interconnected by a hinged connection 5180. A hinged connection allows for the support arm 5100 to be folded towards an adjacent support arm in order to make the bracing apparatus 5000 more compact for transportation and storage. A hinged connection also allows for adjustment of the angle of the support arm 5100 relative to the support pillar in order to avoid obstacles that may be located adjacent to a hole when installing a sub-surface utility anchor. In embodiments where the support pillar 5001 comprises a single vertical member, the support arms 5100 are interconnected to the single vertical member in a radially oriented configuration like that shown in FIGS. 15-16.

As shown in FIG. 15, base plate 5300 is suspended below the support pillar 5001 by flexible hangers 5200 interconnected between the lower end of each vertical member 5150 and base plate 5300. The flexible hangers 5200 may comprise a chain (as shown) or a cable. Base plate 5300 has apertures therethrough which are configured to align with the fastening features 9130 of a given mounting flange or mounting surface 9100, typically with a bolt circle diameter 1135 matching that of the base plate 5300. The base plate 5300 is mechanical interconnected to the mounting flange or mounting surface 9100 by bolts, nuts 5330, screws, or other hardware associated with the mounting flange or mounting surface 9100 so that utility anchor 9000 may be suspended below the support pillar 5100 into a prepared hole or trench wherein the utility anchor is to be installed.

In an alternative embodiment, as shown in FIG. 16, utility anchor 9000 is suspended below the support pillar 5100 by hanger rods 5500 into a prepared hole or trench wherein the utility anchor is to be installed. In certain embodiments, the hanger rods 5500 comprise all-thread rods. In other embodiments, the hanger rods 5500 may be partially threaded at one or both of the upper and lower ends. The hanger rods 5500 may be interconnected to fastening features 9130 by threaded coupling nuts 5550. In this embodiment, passageways in the vertical members 5150 are each axially aligned with a fastening feature 9130 of a given mounting flange or mounting surface 9100, typically with a bolt circle diameter 1135, so that each of the hanger rods 5500 may slideably hang through the passageway in the vertical member 5150. Each vertical member 5150 includes a top plate or washer 5600 through which the hanger rods 5500 pass and are then mechanically constrained to the upper end of the vertical member 5150 by adjustment nuts 5650. Rotation of an adjustment nut 5650 permits minute upward and downward movement of the hanger rod relative to the support pillar in order to raise or lower the fastening feature 9130 to which the hanger rod 5500 is interconnected thereby adjusting the height and/or angular orientation of the mounting flange or mounting surface 9100 of the utility anchor 9000. In other embodiments, hanger rods 5500 may be mechanically constrained by bolts, screws, or other hardware. In an embodiment where the support pillar 5001 comprises a single vertical member, the passageways comprise apertures in at least the top plate which are aligned with fastening features 9130 so that the hanger rods 5500 may each pass through the apertures and then mechanically constrained by nuts 5650 so that the hanger rods 5500 hang down within the single support pillar 5001. In certain embodiments, the bottom plate will also have apertures align with fastening features 9130 and the apertures through the top plate.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A bracing apparatus for the installation of a sub-surface utility anchor comprising:

a support pillar having at least three passageways therethrough, wherein each passageway is aligned with a fastening feature of the sub-surface utility anchor;

at least three hanger rods each comprising an upper and lower end, wherein each hanger rod is adapted to interconnect to one of the fastening features of the sub-surface utility anchor and pass through an aligned passageway of the support pillar;

at least three support arms each comprising a first end and a second end, wherein each first end is interconnected to the support pillar and wherein the first end of at least one support arm is hingedly interconnected to the support pillar; and at least three jacks each interconnected to one of the second ends of each arm, wherein each jack is configured to adjust vertically upward and downward.

2. The bracing apparatus of claim 1 further comprising a leveling indicator related to a mounting flange or mounting surface of the utility anchor.

3. The bracing apparatus of claim 2 wherein the leveling indicator comprises one of a visual analog level indicator, a visual digital level indicator, or a digital level sensor.

4. The bracing apparatus of claim 1 wherein the hanger rods comprise all-thread rods.

5. The bracing apparatus of claim 1 wherein the hanger rods are adapted to adjust vertically upward and downward.

6. The bracing apparatus of claim 5 further comprising at least three adjustment nuts, wherein each nut is threadably interconnected to the upper end of one of the hanger rods and is adapted to mechanically constrain the hanger rod to the support pillar.

7. The bracing apparatus of claim 6 wherein each hanger rod is adapted to interconnect to one of the fastening features of the sub-surface utility anchor by a threaded coupling nut.

8. The bracing apparatus of claim 7 wherein each jack is adapted to adjust the height and the angular orientation of a top surface of a sub-surface utility anchor that is suspended by the bracing apparatus.

9. The bracing apparatus of claim 1 wherein each jack is adapted to adjust the height and the angular orientation of a top surface of a sub-surface utility anchor that is suspended by the bracing apparatus.

10. The bracing apparatus of claim 1 wherein the support pillar comprises a single vertical tube and a top plate.

11. The bracing apparatus of claim 7 wherein each jack is adapted to adjust the height and the angular orientation of a top surface of a sub-surface utility anchor while it is suspended by the bracing apparatus.

12. A bracing apparatus for the installation of a sub-surface utility anchor comprising:

a support pillar comprising four vertical members, each vertical member defining a passageway aligned with a fastening feature of the sub-surface utility anchor;

four hanger rods each comprising an upper and lower end, wherein each hanger rod is adapted to hang within a passageway of a vertical member of the support pillar and to interconnect to one of the fastening features of the sub-surface utility anchor;

four support arms each comprising a first end and a second end, wherein each first end is connected to one of the vertical members of the support pillar; and four jacks each connected to one of the second ends of each arm, wherein each jack is configured to adjust vertically upward and downward.

13. The bracing apparatus of claim 12 wherein each of the four support arms comprises an upper member and a lower member and wherein the first end of at least one of the support arms is hingedly connected to one of the vertical members of the support pillar.

14. The bracing apparatus of claim 12 further comprising a leveling indicator related to the mounting flange or mounting surface of a utility anchor.

15. The bracing apparatus of claim 14 wherein the leveling indicator comprises one of a visual analog level indicator, a visual digital level indicator, or a digital level sensor.

16. The bracing apparatus of claim 12 wherein the hanger rods comprise all-thread rods.

17. The bracing apparatus of claim 12 wherein the hanger rods are adapted to adjust vertically upward and downward.

18. The bracing apparatus of claim 12 further comprising four adjustment nuts, wherein each nut is threadably interconnected to the upper end of one of the hanger rods and is adapted to mechanically constrain the hanger rod to the support pillar.

19. The bracing apparatus of claim 12 wherein each jack is adapted to adjust the height and the angular orientation of a top surface of a sub-surface utility anchor while it is suspended by the bracing apparatus.

* * * * *